United States Patent [19]

Swatek

[11] 4,027,417

[45] June 7, 1977

[54] CARTRIDGE LOADING TRAY

[76] Inventor: Rudolf W. Swatek, 32 Channing Drive, Ringwood, N.J. 07456

[22] Filed: Aug. 24, 1976

[21] Appl. No.: 716,991

[52] U.S. Cl. ..... 42/87; 206/3

[51] Int. Cl.[2] ..... F42B 39/06

[58] Field of Search ..... 42/87–90; 86/44; 206/3

[56] References Cited

UNITED STATES PATENTS

| | | | |
|---|---|---|---|
| 2,920,893 | 1/1960 | Walker | 42/87 |
| 3,182,417 | 5/1965 | Hamilton | 42/89 |
| 3,813,987 | 6/1974 | Minneman | 86/44 |
| 3,990,170 | 11/1976 | Griffis | 42/89 |

*Primary Examiner*—Charles T. Jordan

*Attorney, Agent, or Firm*—Joel Halpern

[57] ABSTRACT

A cartridge loading tray for use with speed loaders includes an assembly of an upper rigid board, a lower rigid board therebelow and a layer of resilient material therebetween. A plurality of groups of circularly arranged apertures are formed in the rigid boards and in the resilient layer. The apertures in the upper board and in the resilient layer extend therethrough and the apertures in the lower board are blind bores therein which extend from the interface thereof with the resilient layer. The diameter of the apertures in the upper and lower boards are equal. The diameter of the apertures in the resilient layer are less than the corresponding and aligned apertures of the upper and lower boards.

6 Claims, 5 Drawing Figures

FIG.1
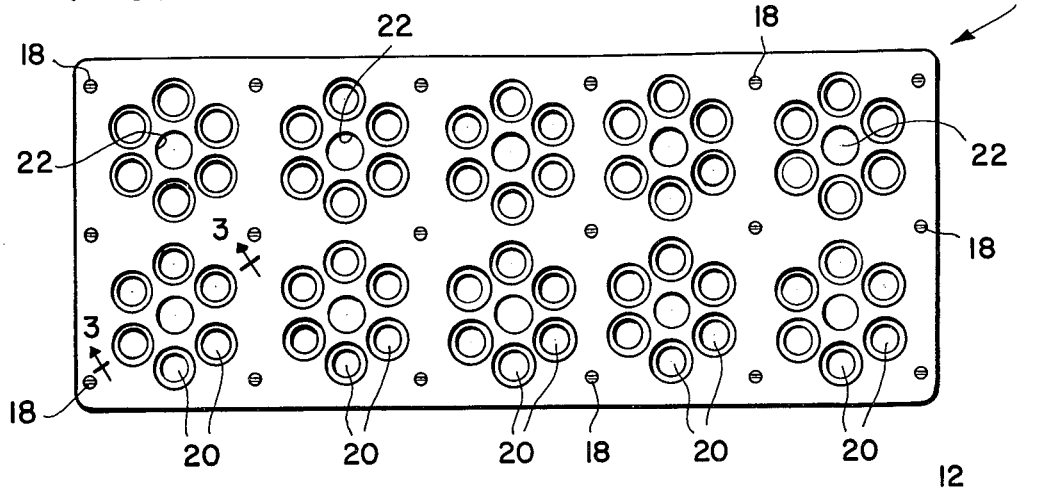
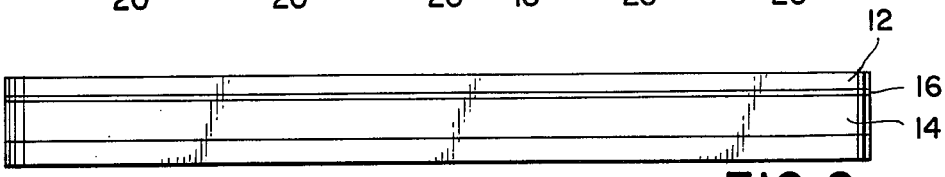
FIG.2
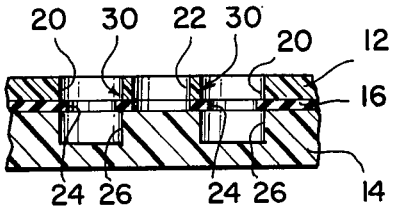
FIG.3
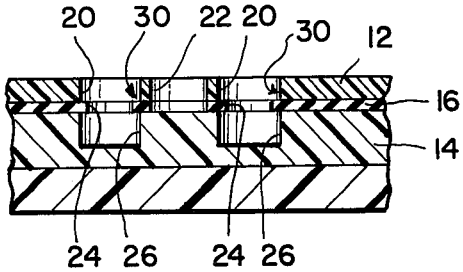
FIG.4
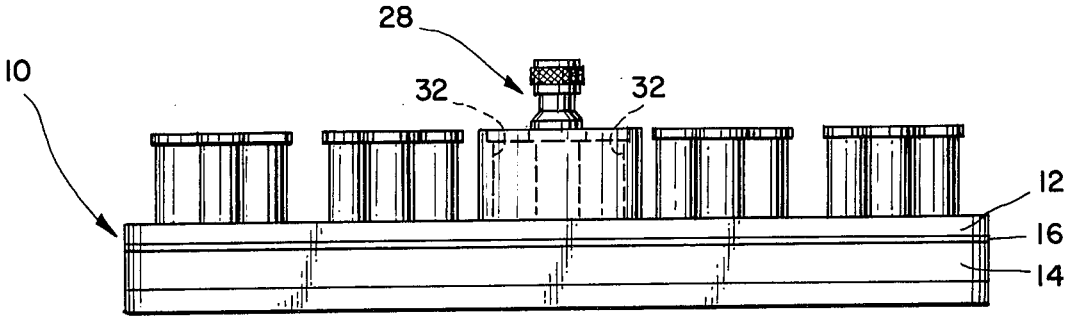
FIG.5

CARTRIDGE LOADING TRAY

BACKGROUND OF THE INVENTION

The present invention relates to a cartridge loading tray for use with speed loaders.

Cartridge trays and cartridge loading blocks available heretofore have generally been utilizable only with cartridges of the same caliber. Accordingly, when cartridges of various calibers were to be loaded on the trays or blocks it was usually necessary to have a tray or block for each caliber cartridge. U.S. Pat. No. 3,244,058 issued Apr. 5, 1966 to H. D. Hulterstrm and U.S. Pat. No. 3,813,987 to William J. Minneman disclosed improved loading blocks capable of use with ammunition of different caliber. Briefly, the patented structures relied upon blocks in which chambers of different size were located on the opposed sides of the block. However, it is apparent that only one side of the block can be used at a given time. Thus, either the block was limited to the use of cartridges having the same size as the chambers on the side employed or, where different size chambers were located on the same side of the block the capacity of the block for use with a particular size was limited.

SUMMARY OF THE INVENTION

It is one object of the invention to provide a cartridge loading tray for use with speed loaders having the capacity to accept cartridges of different calibers and to maintain such cartridges in secure upright position.

It is another object of the invention to provide a cartridge loading tray of the character described which is of simple construction.

Other objects and advantages of the invention will become readily apparent to persons skilled in the art from the following description of the invention.

According to the present invention there is provided a cartridge loading tray for use with speed loaders comprising in combination an assembly including upper and lower superposed rigid boards and a layer of resilient material therebetween; a plurality of groups of apertures formed in the upper board extending therethrough, each of the groups being arranged in a circular pattern; a plurality of apertures formed in the layer of resilient material equal in number to and in alignment with the apertures of the groups in the upper board, and the diameter of the apertures in the resilient layer being less than that of the apertures in the upper board; and a plurality of groups of apertures formed in the lower board equal in number to and in alignment with the apertures of the groups in the upper board and intermediate resilient layer, the diameter of the apertures in the lower board being equal to those of the upper board, and the apertures in the lower board extending from the interface between same and the resilient layer and terminating therewithin.

BRIEF DESCRIPTION OF THE DRAWING

In order that the invention may be more fully comprehended it will now be described, by way of example, with reference to the accompanying drawings in which:

FIG. 1 is a top plan view of a cartridge loading tray constructed in accordance with the invention;

FIG. 2 is a side elevational view of the cartridge loading tray of FIG. 1;

FIG. 3 is a fragmentary cross-sectional view of the cartridge loading tray shown in FIG. 1 taken along line 3—3 thereof;

FIG. 4 is a view similar to that of FIG. 3 illustrating the use of a foam rubber pad with the loading tray; and FIG. 5 is a view similar to that of FIG. 2 showing cartridges and a speed loader in position on the tray.

DETAILED DESCRIPTION OF THE PREFERRED EMBODIMENT

Referring to the drawings there is shown generally, as indicated by reference numeral 10, a cartridge loading tray. The tray essentially comprises an assembly which includes upper 12 and lower 14 superposed rigid boards which are preferably formed of a suitable synthetic plastics material such as polypropylene. Interposed between the boards 12, 14 is a layer of resilient material 16 which is an elastomeric material such as natural or synthetic rubber. The rigid boards and intermediate resilient layer are secured together as an assemblage by fastening means such as machine screws 18.

A plurality of groups of apertures 20 are formed in upper board 12 and extend completely therethrough. Each of the groups are circularly arranged. Such apertures are desirably 7/16 inch in diameter. Centrally of each group there is provided an aperture 22 of lesser diameter than that of apertures 20. Apertures 22 may be 25/64 inch diameter.

The intermediate resilient layer 16 is provided with a plurality of groups of apertures 24 corresponding in location with apertures 20 of board 12. However the diameter of apertures 24 is less than that of apertures 20. A diameter of 5/16 inch has been found suitable for apertures 24. The combined thickness of the assembled boards and intermediate layer may be approximately 19/32 inch. Thus the upper board may be 5/32 inch; the intermediate resilient layer may be 1/16 inch; and the lower board may be ⅝ inch thick. The combined depth of apertures 20, 24 and 26, to be described, is desirably approximately 7/16 inch.

The lower board of the assembly is formed with a plurality of groups of apertures 26 which are equal in number and in alignment with the apertures in upper board 12 and intermediate layer 16. Apertures 26, however, unlike the apertures in the upper board and in the intermediate layer do not extend completely through the lower board. They are formed as blind bores in the lower board and extend from the interface of the lower board and the intermediate resilient layer to a point therewithin.

As depicted in FIGS. 1 and 5 ten groups of apertures are preferably formed in the boards and intermediate layer. However, as will be understood, the exact number of groups is not critical to the invention. In FIG. 5 a speed loader 28 is shown in position on the tray. The speed loaders which may be employed most effectively with the tray of the invention are the H.K.S. Tool Model Nos. 10M and PYM and are disclosed in U.S. Pat. No. 3,722,125. However, with slight modification, within the ambit of the invention, the tray can be modified to accommodate other speed loaders.

If desired the tray may be furnished a cover (not shown) so as to enhance the use of the tray as a storage container for the cartridges. Due to the provision of the intermediate resilient layer having smaller diameter apertures than those of the upper and lower boards a range of cartridges having different calibers can be accommodated thereby rendering it unnecessary to provide chambers in both sides of the device.

The aligned apertures 20, 24, 26 form chambers 30 in the assemblage within which the cartridges 32 may be positioned.

It will thus be seen that a simply constructed cartridge loading tray has been provided adapted to accommodate cartridges of varying calibers without diminution of the total capacity of the tray or requiring the use of more than one tray with more than one caliber cartridge.

I claim:

1. A cartridge loading tray for use with speed loaders comprising in combination:

an assembly including upper and lower superposed rigid boards and a layer of resilient material therebetween;

a plurality of groups of apertures formed in said upper board extending therethrough, each of said groups being arrange in a circular pattern;

a plurality of groups of apertures formed in said layer of resilient material equal in number to and in alignment with the apertures of the groups in said upper board, and the diameter of the apertures in said resilient layer being less than that of the apertures in said upper board; and a plurality of groups of apertures formed in said lower board equal in number to and in alignment with the apertures of the groups in said upper board and intermediate resilient layer, the diameter of the apertures in said lower board being equal to those of said upper board, and the apertures in said lower board extending from the interface between same and said resilient layer and terminating therewithin.

2. A cartridge loading tray according to claim 1, wherein said upper and lower rigid boards are formed of a synthetic plastics material and said resilient layer comprises an elastomeric material.

3. A cartridge loading tray according to claim 1, wherein said upper and lower rigid boards and said intermediate layer of resilient material are secured in assembled relation.

4. A cartridge loading tray according to claim 1, wherein an additional aperture is formed in said upper rigid board centrally within each of said circularly arranged groups of apertures, each said central aperture being of lesser diameter than the apertures of the surrounding group of apertures.

5. A cartridge loading tray according to claim 1, wherein a foam rubber pad is secured to the face of said lower rigid board remote from the interface with said resilient layer.

6. A cartridge loading tray according to claim 1, wherein ten of said groups of apertures are formed in said upper and lower rigid boards and in said resilient layer.

* * * * *